US006557356B2

(12) United States Patent
Underwood

(10) Patent No.: US 6,557,356 B2
(45) Date of Patent: May 6, 2003

(54) AIR PURIFICATION DEVICE FOR AIR CONDITIONING EVAPORATOR COIL

(76) Inventor: Roy E. Underwood, 4705 Upper Plott Rd., Young Harris, GA (US) 30582

( * ) Notice: Subject to any disclaimer, the term of this patent is extended or adjusted under 35 U.S.C. 154(b) by 0 days.

(21) Appl. No.: 09/891,436

(22) Filed: Jun. 27, 2001

(65) Prior Publication Data

US 2003/0000229 A1 Jan. 2, 2003

(51) Int. Cl.[7] ..... F24F 3/16; F25D 23/12; A61L 2/00

(52) U.S. Cl. ..... 62/78; 62/259.1; 422/24; 422/28

(58) Field of Search ..... 62/259.1, 78; 165/122; 422/24, 28

(56) References Cited

U.S. PATENT DOCUMENTS 5,207,074 A * 5/1993 Cox et al. ..... 165/127
5,286,447 A * 2/1994 Fannin et al. ..... 422/28
5,334,347 A * 8/1994 Hollander ..... 422/24
5,366,705 A * 11/1994 Reidy ..... 422/243
5,558,158 A * 9/1996 Elmore ..... 165/122
5,987,908 A * 11/1999 Wetzel ..... 62/259.1
6,234,241 B1 * 5/2001 Elmore ..... 165/122

* cited by examiner

*Primary Examiner*—William C. Doerrler
*Assistant Examiner*—Filip Zec
(74) *Attorney, Agent, or Firm*—Harry I. leon; Vivian L. steadman

(57) ABSTRACT

A device for killing pathogens that grow on the surface of the evaporator coil within a conventional air conditioner and in the drip pan of its evaporator. Utilizing ultraviolet radiation which is well-known to kill a wide range of pathogens, the device comprises at least one elongated ultraviolet light source. This source is positioned in such a way that its light strikes both the evaporator and the drip pan. Also this source is mounted transversely to the flow path of air passing through the evaporator.

2 Claims, 2 Drawing Sheets

AIR PURIFICATION DEVICE FOR AIR CONDITIONING EVAPORATOR COIL

BACKGROUND OF THE INVENTION

The evaporator coil in a central air conditioning system is an ideal location for bacteria and other microorganisms to grow. Some of them are pathogens while others just add a foul smell to the air. Moisture in the air, which tends to condense on the cool surface of the evaporator coil, is usually captured in a drip pan which is not only equipped with a drain but also designed so that the air flowing past the evaporator coil picks up moisture accumulated in the pan. Notwithstanding these features, the pan does retain a certain amount of water. Conditions are such that microorganisms present in the incoming air may lodge and grow in the moist pan and on the coil surface. There is always the chance that bacteria, viruses, yeast mold, mildew and their various spores will get into the air stream flowing past the evaporator coil and its drip pan.

SUMMARY OF THE INVENTION

The object of this invention is to provide a means for irradiating, with ultraviolet light, surfaces of the evaporator coil and drip pan in such a way to both kill and prevent any buildup of pathogens thereon.

In accordance with the present invention, the irradiating means comprises an elongated ultraviolet lamp which is mounted centrally relative to the evaporator coil surfaces, so that its light strikes them, and transversely to the flow path of the air as it passes through the evaporator. Shielding the lamp is a quartz tube which envelopes it.

In the preferred embodiment, one end of the quartz tube is secured, using a sleeve which projects perpendicularly from a flat base, to a sidewall of a sheet metal container surrounding the evaporator coil shell. Slip-fitted into the outwardly protruding sleeve, the quartz tube extends into the shell itself through concentric holes formed in it and in the sidewall. These holes measure, by way of example, 1 inch and 3 inches in diameter, respectively. In a conventional "A" frame-type evaporator coil, the quartz tube, with the ultraviolet lamp inserted therewith in, is positioned midway between the legs of the "A" frame.

DETAILED DESCRIPTION OF THE PREFERRED EMBODIMENT

Figure 3:
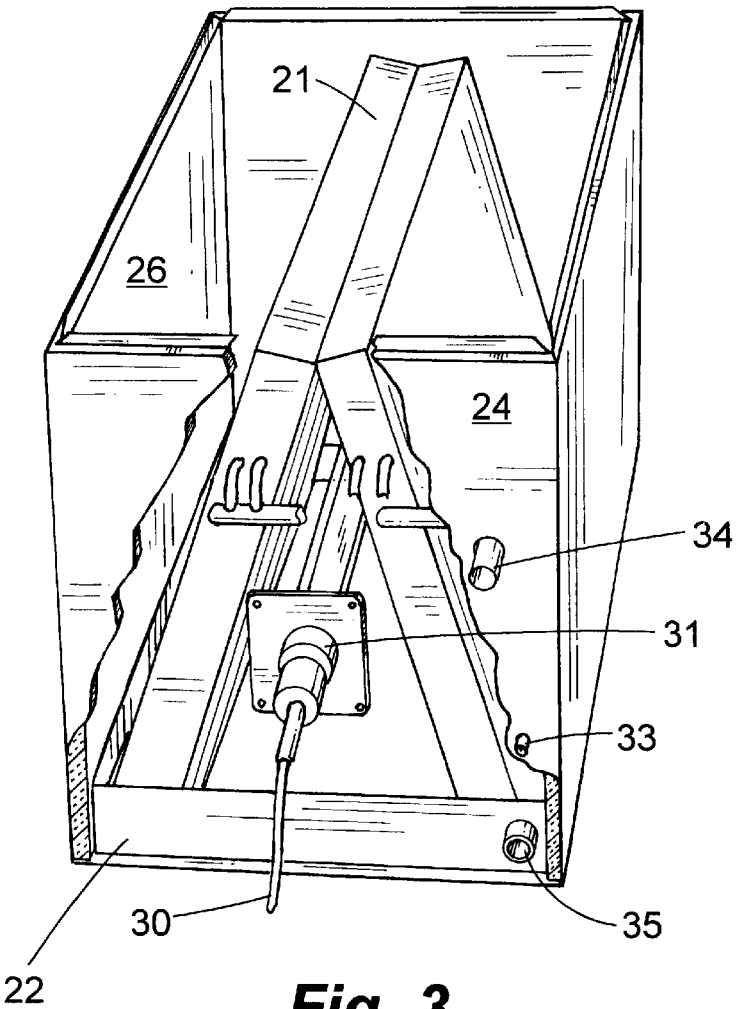
FIG. 3 is a perspective view with a breakout section showing the air purification device according to FIG. 1 installed in an evaporator having an "A" frame-type evaporator coil.

In the drawings, a device for purifying air as it passes through the evaporator coil of an air conditioner is indicated generally by the reference numeral 10. The device 10 comprises an ultraviolet light source 11 enclosed in a quartz tube 12 mounted within an air conditioner 20 near its evaporator coil 21. For a typical "A" frame-type evaporator coil, the ultraviolet lamp 11 is disposed above the drip pan 22 and midway between the legs of the coil (FIG. 3).

Figure 1:
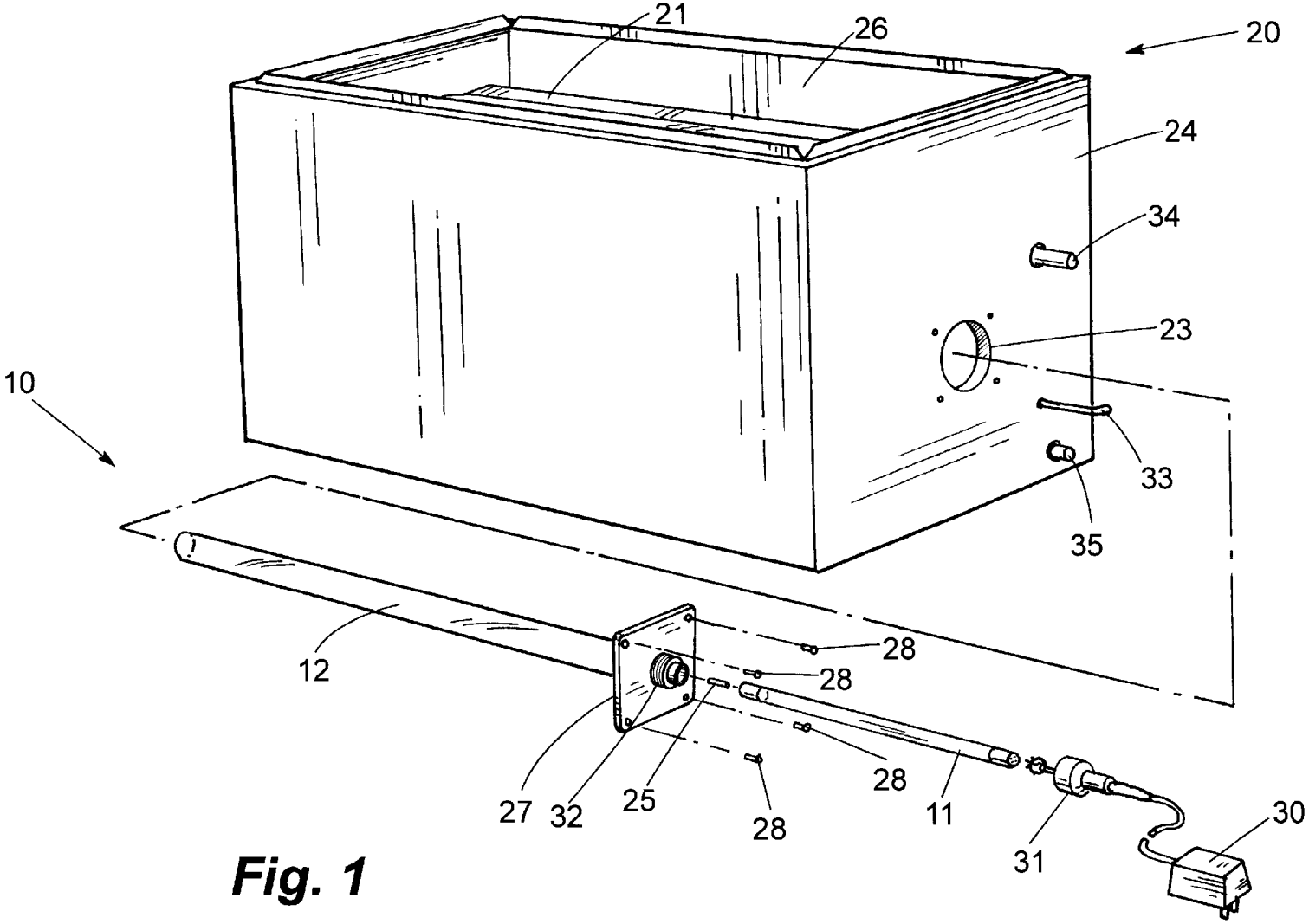
FIG. 1 is an exploded perspective view of the air purification device according to the present invention showing the ultraviolet lamp, the quartz tube shielding it, and the sheet metal container surrounding the evaporator coil and its shell, on which the device is mounted.
Figure 2:
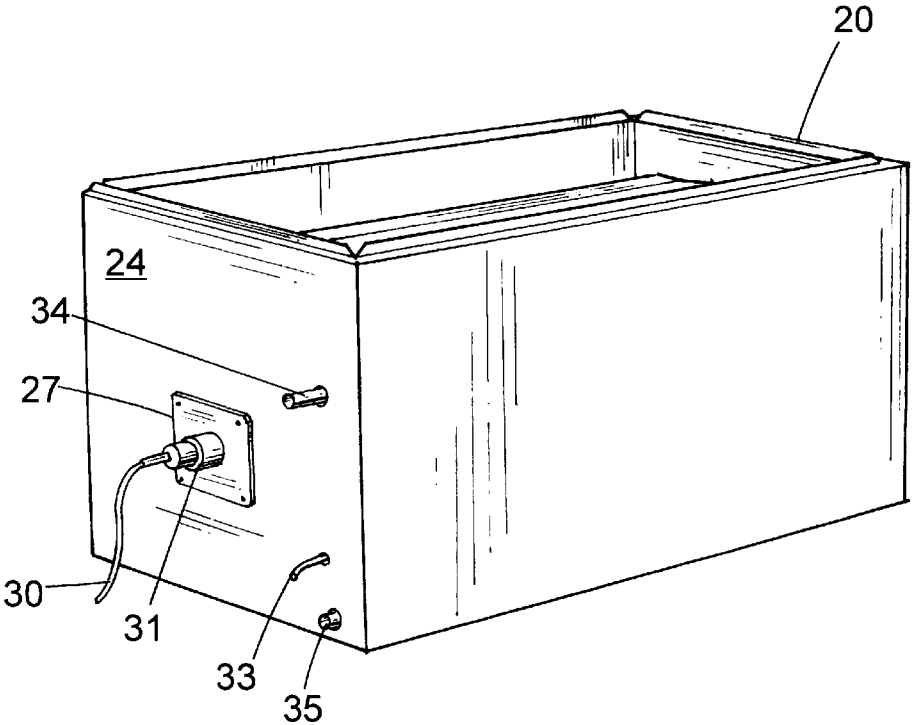
FIG. 2 is a top right side perspective view of the air purification device according to FIG. 1 when said device has been installed.

To install the ultraviolet lamp 11, one cuts two concentric holes: a hole 23 in the sidewall 24 of a sheet metal container surrounding the shell 26 of the evaporator coil 21 and a smaller concentric hole (not shown) is cut in the shell itself. Mounting screws 28 are used to attach a base 27 holding the quartz tube 12 to the sidewall 24 (FIG. 1). A small rubber cushion 25 is inserted into quartz tube 12 just ahead of the ultraviolet lamp 11 (FIG. 1). Holding the quartz tube 12 and the light source 11 in assembled relation and the latter in electrical contact with its power supply 30 is a cap 31 and its mating surface 32 affixed to the quartz tube. Also shown in FIGS. 1 through 3 are the high and low pressure evaporator connections 33 and 34 and the drip pan drain 35.

It is understood that those skilled in the art may conceive other applications, modifications and/or changes in the invention described above. Any such applications, modifications or changes which fall within the purview of the description are intended to be illustrative and not intended to be limitative. The scope of the invention is limited only by the scope of the claims appended hereto.

What is claimed is:

1. In an air conditioner equipped with an "A" frame-type evaporator coil and drip pan, the drip pan having inner walls, a combination with said evaporator coil and drip pan of an elongated ultraviolet lamp mounted centrally with respect to the evaporator coil and the drip pan; lines of sight between the lamp and portions of the inner walls being open, so that ultraviolet light from the lamp strikes both evaporator coil surfaces and the drip pan, the lamp being disposed transversely to the flow path of the air.

2. In an air conditioner equipped with an "A" frame-type evaporator coil and drip pan, the evaporator coil including a pair of legs which diverge downwardly, a combination with said evaporator coil of an elongated ultraviolet lamp mounted above the drip pan and midway between the legs of the coil, the lamp being disposed transversely to the flow path of the air, so that ultraviolet light from the lamp strikes both evaporator coil surfaces and the drip pan and simultaneously irradiates air-borne particulates as they stream between these legs.

* * * * *